US011833816B2

(12) United States Patent
Yaita et al.

(10) Patent No.: US 11,833,816 B2
(45) Date of Patent: Dec. 5, 2023

(54) PRINTING APPARATUS AND RECOVERY METHOD THEREFOR

(71) Applicant: CANON KABUSHIKI KAISHA, Tokyo (JP)

(72) Inventors: Satoko Yaita, Kawasaki (JP); Kei Kosaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/728,604

(22) Filed: Apr. 25, 2022

(65) Prior Publication Data

US 2022/0242113 A1 Aug. 4, 2022

Related U.S. Application Data

(63) Continuation of application No. 16/832,431, filed on Mar. 27, 2020, now Pat. No. 11,338,579.

(30) Foreign Application Priority Data

Apr. 2, 2019 (JP) ..... 2019-070713

(51) Int. Cl.
*B41J 29/38* (2006.01)
*B41J 2/045* (2006.01)

(52) U.S. Cl.
CPC ..... *B41J 2/04573* (2013.01); *B41J 2/04541* (2013.01); *B41J 2/04553* (2013.01); *B41J 2/04563* (2013.01)

(58) Field of Classification Search
CPC ..... B41J 2/17553; B41J 2/2142; B41J 2/1652
See application file for complete search history.

(56) References Cited

U.S. PATENT DOCUMENTS 5,182,583 A * 1/1993 Horigome ..... B41J 2/1652 346/146
5,543,826 A 8/1996 Kuronuma et al. ..... B41J 2/165
(Continued)

FOREIGN PATENT DOCUMENTS

JP S61-230942 10/1986
JP S63-247049 10/1988
(Continued)

OTHER PUBLICATIONS

Office Action dated Feb. 20, 2023 in counterpart Japanese Application No. 2019-070713, together with English translation thereof.
(Continued)

*Primary Examiner* — Lam S Nguyen
(74) *Attorney, Agent, or Firm* — Venable LLP

(57) ABSTRACT

A printing apparatus according to an embodiment of this present invention includes a printhead with an orifice for discharging ink, and a recovery unit configured to perform recovery of the printhead by driving a print element of the printhead to discharge ink from the orifice. The apparatus makes a setting for a request for discharge recovery by the recovery unit after initialization processing performed upon power-on of the printing apparatus, and controls the recovery unit to execute one of first discharge recovery and second discharge recovery in which an ink discharge amount is smaller than in the first discharge recovery in accordance with the setting before a start of printing by the printhead.

13 Claims, 12 Drawing Sheets

(56) References Cited

U.S. PATENT DOCUMENTS

| | | | | |
|---|---|---|---|---|
| 5,819,013 | A | 10/1998 | Miyazaki et al. | 358/1.15 |
| 7,950,787 | B2 | 5/2011 | Takahashi | 347/85 |
| 8,702,192 | B2 | 4/2014 | Danzuka et al. | B41J 23/00 |
| 9,108,410 | B2 | 8/2015 | Hamasaki et al. | B41J 11/008 |
| 9,446,595 | B2 | 9/2016 | Takarabe et al. | B41J 2/1652 |
| 9,517,628 | B2 | 12/2016 | Tenkawa et al. | B41J 2/17566 |
| 10,207,506 | B2 | 2/2019 | Iwasaki et al. | B41J 2/16508 |
| 2008/0122891 | A1* | 5/2008 | Nakano | B41J 2/2142 347/19 |
| 2009/0066736 | A1* | 3/2009 | Edamura | B41J 2/17553 347/9 |

FOREIGN PATENT DOCUMENTS

| | | |
|---|---|---|
| JP | H02-092548 | 4/1990 |
| JP | H03-240555 | 10/1991 |
| JP | H04-232064 | 8/1992 |
| JP | H05-309834 | 11/1993 |
| JP | 2004-230646 | 8/2004 |
| JP | 2012-030511 | 2/2012 |

OTHER PUBLICATIONS

Office Action dated Dec. 2, 2022 in counterpart Japanese Application No. 2019-070713, together with English translation thereof.

* cited by examiner

| TYPE OF DISCHARGE RECOVERY | ELAPSED TIME (T1) | NO. OF DISCHARGES |
|---|---|---|
| DISCHARGE RECOVERY A | 0 hrs ≤ T1 < 6 hrs | 70 |
| | 6 hrs ≤ T1 < 24 hrs | 800 |
| | T1 ≤ 24hrs | 1300 |
| DISCHARGE RECOVERY B | — | 30 |

PRINTING APPARATUS AND RECOVERY METHOD THEREFOR

This application is a continuation of application Ser. No. 16/832,431 filed Mar. 27, 2020, currently pending, and claims priority under 35 U.S.C. § 119 from Japan application No. 2019-070713 filed in Japan on Apr. 2, 2019; the content of all of which are incorporated herein by reference as if set forth in full.

BACKGROUND OF THE INVENTION

Field of the Invention

The present invention relates to a printing apparatus and a recovery method therefor, and particularly to, for example, a printing apparatus for executing printing by discharging ink from a printhead according to an inkjet method, and a recovery method for the printing apparatus.

Description of the Related Art

A recent inkjet printing apparatus (to be referred to as a printing apparatus hereinafter) is known to include a recovery mechanism for executing a recovery operation by discharging ink to a place other than a print medium in order to maintain, in a satisfactory state, nozzles for discharging ink. This discharge recovery operation aims at discharging ink with an increased viscosity in nozzles of a printhead, bubbles, and mixed color ink, and removing wetness, ink, and dust around orifices.

In general, if the initialization operation of the recovery mechanism is executed upon power-on of the printing apparatus, an arrangement for opening a cap that covers the orifices of the printhead is provided for the purpose of immediately starting a print operation without making the user wait in the end of the initialization operation (see Japanese Patent Laid-Open No. 2-092548). When the cap is opened, discharge recovery is executed to prevent drying of the nozzles.

However, if the user does not start a print operation immediately after power-on, a capping operation is performed after a predetermined time elapses. Then, if a print instruction is received, the cap is opened again and discharge recovery is executed. Consequently, a recovery operation is repeatedly executed, thereby wastefully consuming ink. To cope with this, as conventionally proposed in Japanese Patent Laid-Open No. 63-247049, although the initialization operation of a recovery mechanism is performed upon power-on to open a cap, no discharge recovery operation is executed, and thus discharge recovery is executed for the first time upon receiving a print instruction.

However, in Japanese Patent Laid-Open No. 63-247049, since the ink consumption amount is constant in the recovery operation executed before the start of printing, if the printing apparatus is left unused for a long time after power-on, an amount of bubbles and ink with an increased viscosity in the nozzles of the printhead may undesirably increase. Thus, even if the recovery operation is executed to discharge ink, an ink amount enough to recover the discharge performance of the printhead cannot be discharged, resulting in a discharge failure. If an unused time is short, the ink discharge amount is the same as that when the printing apparatus is left for a long time, and thus ink discharge is performed more than necessary, thereby wastefully consuming ink.

SUMMARY OF THE INVENTION

Accordingly, the present invention is conceived as a response to the above-described disadvantages of the conventional art.

For example, a printing apparatus and a recovery method therefor according to this invention are capable of maintaining a printhead in a satisfactory state by performing an appropriate recovery operation while suppressing wasteful ink consumption at the time of power-on.

According to one aspect of the present invention, there is provided a printing apparatus including a printhead with an orifice for discharging ink, and a recovery unit configured to perform recovery of the printhead by driving a print element of the printhead to discharge ink from the orifice, the apparatus comprising: a setting unit configured to make a setting for a request for discharge recovery by the recovery unit after initialization processing performed upon power-on of the printing apparatus; and a control unit configured to control the recovery unit to execute one of first discharge recovery and second discharge recovery in which an ink discharge amount is smaller than in the first discharge recovery in accordance with the setting by the setting unit before a start of printing by the printhead.

According to another aspect of the present invention, there is provided a recovery method for a printing apparatus including a printhead with an orifice for discharging ink, and a recovery unit configured to perform recovery of the printhead by driving a print element of the printhead to discharge ink from the orifice, the method comprising: making a setting for a request for discharge recovery by the recovery unit after initialization processing performed upon power-on of the printing apparatus; and controlling the recovery unit to execute one of first discharge recovery and second discharge recovery in which an ink discharge amount is smaller than in the first discharge recovery in accordance with the setting before a start of printing by the printhead.

The invention is particularly advantageous since an ink discharge amount consumed by discharge recovery executed before the start of printing is controlled, and it is thus possible to maintain the printhead in a satisfactory state while suppressing wasteful ink consumption.

Further features of the present invention will become apparent from the following description of exemplary embodiments (with reference to the attached drawings).

DESCRIPTION OF THE EMBODIMENTS

Figure 1:
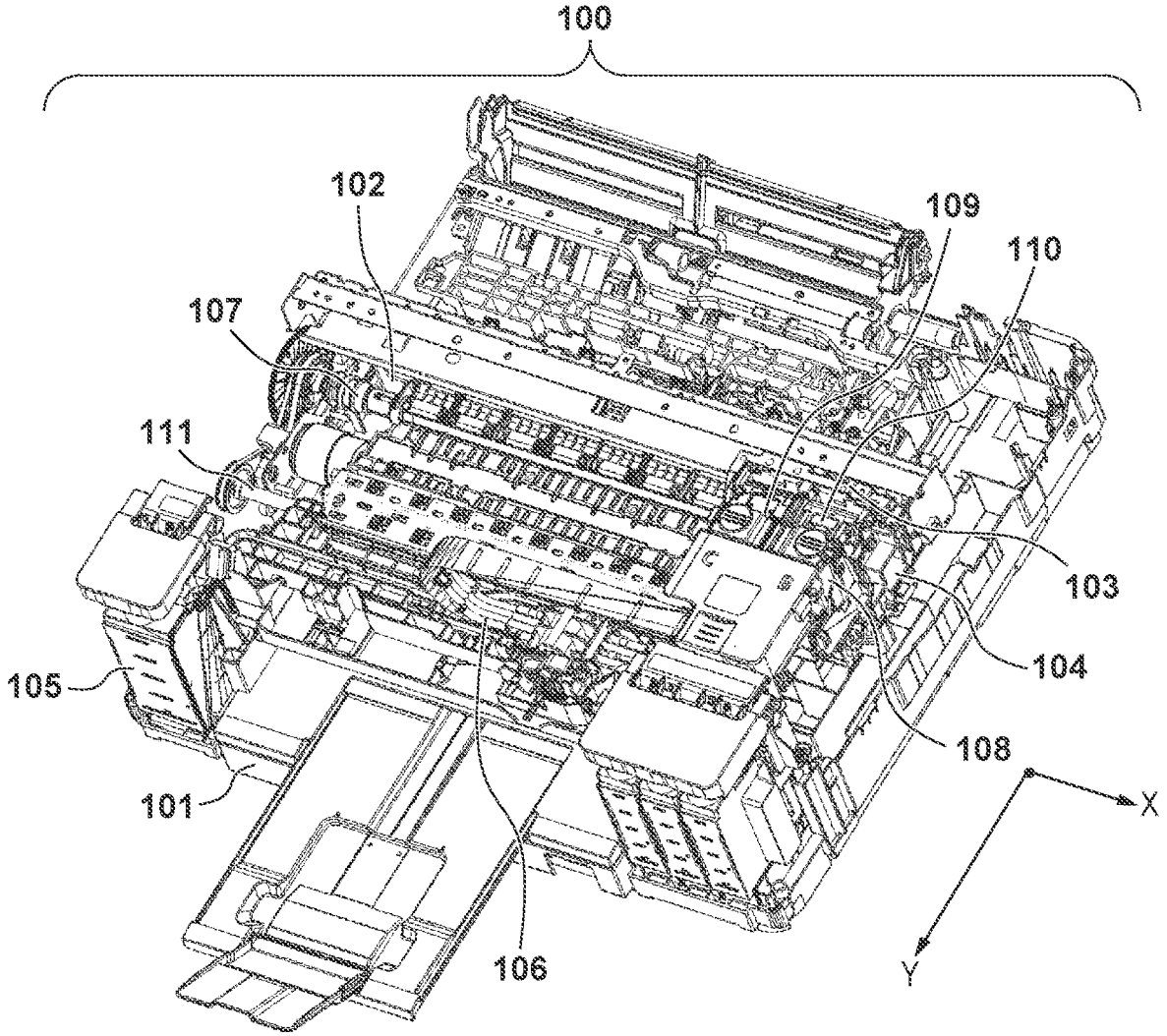
FIG. 1 is a perspective view showing an outline of the arrangement of a printing apparatus including a printhead adopting an inkjet method according to an exemplary embodiment of the present invention.

Exemplary embodiments of the present invention will now be described in detail in accordance with the accompanying drawings. Note that the following embodiments do not limit the invention according to the scope of the appended claims. Although a plurality of features are described in the embodiments, not all the features are essential to the invention and the plurality of features may arbitrarily be combined. Throughout the accompanying drawings, the same reference numerals denote the same or similar components and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" (to be also referred to as "print element" hereinafter) generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Explanation of Outline of Printing Apparatus (FIGS. 1 to 4)>

FIG. 1 is an external perspective view showing an outline of the arrangement of a printing apparatus 100 for executing printing using an inkjet printhead (to be referred to as a printhead hereinafter) according to an exemplary embodiment of the present invention. As shown in FIG. 1, the printing apparatus 100 includes a feeding unit 101, a conveyance unit 102, a print unit 103, a recovery mechanism 104, an ink tank 105, and an ink supply tube 106.

Print media stacked on the feeding unit 101 are picked up and sent one by one by a pickup roller (not shown) driven by a feeding motor (not shown) and a feeding roller, and fed to the conveyance unit 102. The conveyance unit 102 conveys the print medium supplied by the feeding unit 101. The print medium fed to the conveyance unit 102 is nipped by a pinch roller (not shown) and a conveyance roller 107 driven by a conveyance motor (not shown), and conveyed to pass through the print unit 103.

The print unit 103 prints an image by discharging ink from the printhead (to be described later) to the print medium based on image data. Ink is supplied from the ink tank 105 to the printhead via the ink supply tube 106. The print unit 103 includes a carriage 108 that can reciprocally move in the X direction (scanning direction) intersecting the conveyance direction (Y direction) of the print medium, and printheads 109 and 110 (to be described later) mounted on the carriage 108. The carriage 108 is supported to be able to reciprocally move in the X direction along a guide rail arranged on the printing apparatus. The carriage 108 reciprocally moves in a print region via a carriage belt (not shown) driven by a carriage motor (not shown) when executing printing on the print medium.

The position in the X direction and the speed of the carriage 108 are detected by an encoder sensor (not shown) mounted on the carriage 108 and an encoder scale (not shown) stretched in the X direction on the printing apparatus 100. The movement of the carriage 108 is controlled based on the position and speed. While the carriage 108 moves, printing is executed on the print medium by discharging ink from the printheads 109 and 110. The print medium is nipped by a discharge roller 111 driven by the conveyance unit 102 in synchronism with the conveyance roller 107 and a spur (not shown) pressed against the discharge roller 111, and discharged outside the printing apparatus 100.

Figure 2:
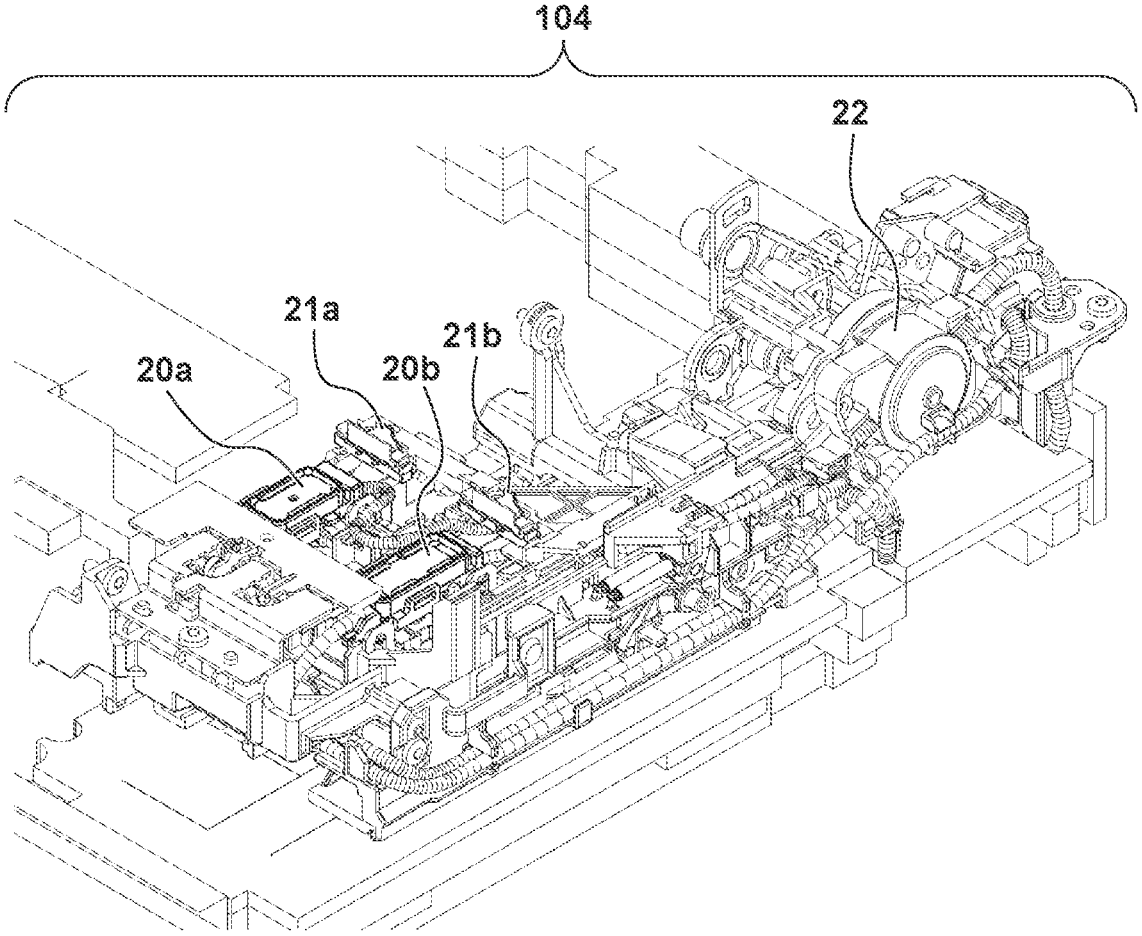
FIG. 2 is a perspective view showing the detailed arrangement of a recovery mechanism of the printing apparatus shown in FIG. 1.

FIG. 2 is a perspective view showing the detailed arrangement of the recovery mechanism 104.

In FIG. 2, caps 20*a* and 20*b* cover orifices of the printheads 109 and 110, respectively, thereby preventing drying of the discharge surfaces of the printheads. The cap 20*a* or 20*b* and the printhead 109 or 110 can relatively move to a capping position at which the discharge surface of the printhead is sealed and a separated position at which the cap is spaced apart from the discharge surface of the printhead. Wipers 21*a* and 21*b* have roles in recovering the states of the discharge surfaces to a normal state by wiping ink droplets attached to the surfaces (discharge surfaces) of the printheads 109 and 110 on which nozzles are provided, respectively. In addition, a suction mechanism 22 removes bubbles in the nozzles of the printheads 109 and 110, discharges ink with an increased viscosity, and refills with ink by sucking ink from the orifices of the printheads 109 and 110 by the caps 20*a* and 20*b*. Note that a position at which the printheads 109 and 110 oppose the recovery mechanism 104 will be referred to as the home position of the carriage 108 hereinafter.

FIGS. 3A to 3E are views each showing the schematic arrangement of the printhead amounted on the printing apparatus shown in FIG. 1.

Figure 3A:
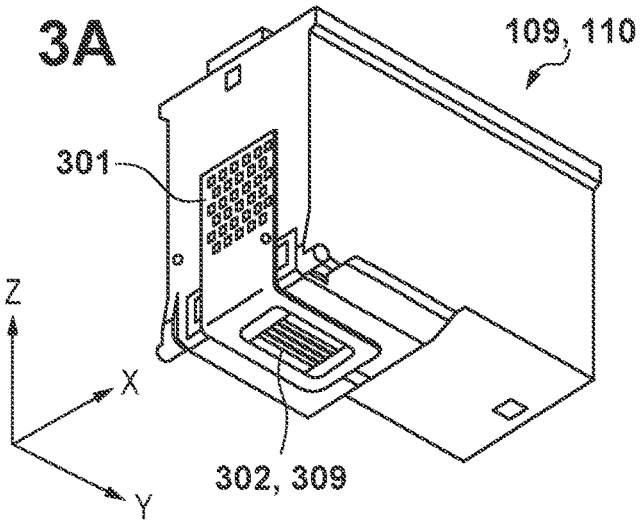
FIGS. 3A, 3B, 3C, 3D, and 3E are views each showing the schematic arrangement of the printhead amounted on the printing apparatus shown in FIG. 1.
Figure 3B:
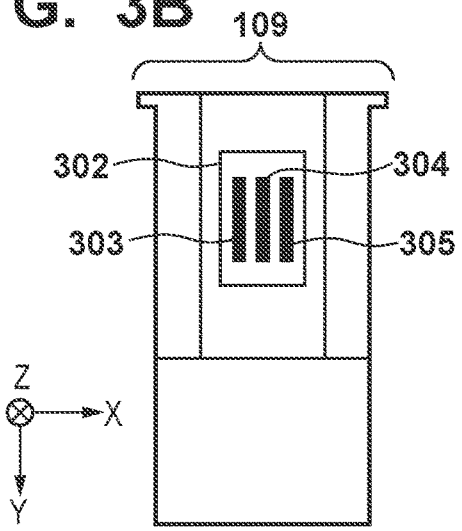
Figure 3C:
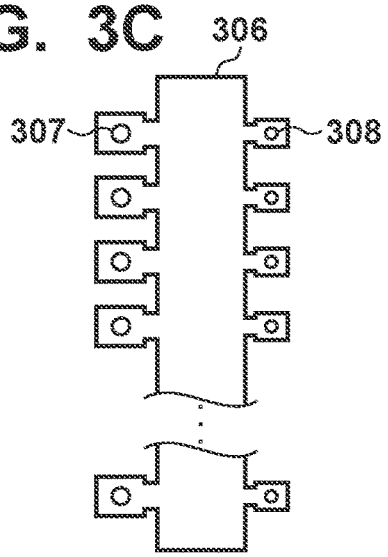

FIG. 3A is a perspective view showing the printhead 109 or 110. FIG. 3B is a bottom view when viewing the printhead 109 in the Z direction. FIG. 3C is an enlarged view showing a cyan ink orifice array 303 of the printhead 109.

Figure 3D:
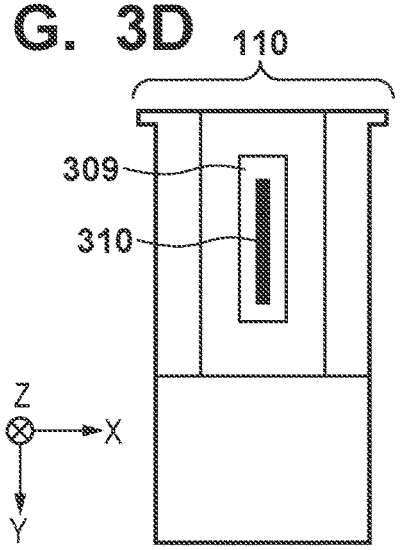
Figure 3E:
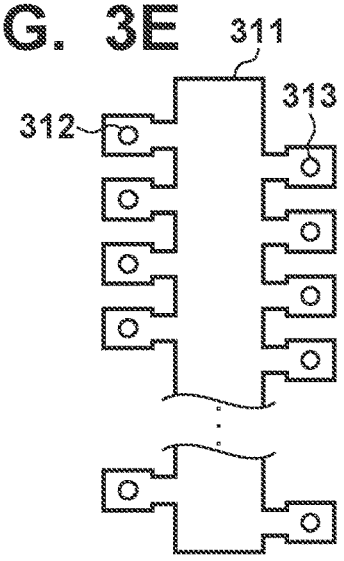

FIG. 3D is a bottom view when viewing the printhead 110 in the Z direction. FIG. 3E is an enlarged view showing a black ink orifice array 310 of the printhead 110.

Each of the printheads 109 and 110 is supplied with power necessary to receive a print signal from the main body of the printing apparatus 100 via a contact pad 301 and drive the printhead. In the case of the printhead 109, as shown in FIG. 3B, the orifice array 303 for discharging cyan ink, an orifice array 304 for discharging magenta ink, and an orifice array 305 for discharging yellow ink are arranged in a head chip 302. FIG. 3C shows the cyan ink orifice array 303 as an example, in which orifices 307 each for discharging a large ink droplet (5 pl) and orifices 308 each for discharging a small ink droplet (2 pl) are arranged on two sides of an ink liquid chamber 306.

On the other hand, as shown in FIG. 3D, the orifice array 310 for discharging black ink is arranged in a head chip 309 of the printhead 110. As shown in FIG. 3E, orifices 312 and 313 each for discharging a large droplet (12 pl) are arranged on two sides of an ink liquid chamber 311.

Each of the printheads 109 and 110 is a printhead according to the inkjet method of discharging ink using thermal energy, and includes a plurality of electrothermal transducers for generating thermal energy. According to this method, thermal energy is generated by pulse signals applied to the electrothermal transducers to cause film boiling in ink, and ink is discharged from the orifices using the foaming pressure of film boiling, thereby executing printing.

Note that for the printing apparatus having the above arrangement, the arrangement of supplying ink to the printhead via the tube has been exemplified. However, an arrangement (on-carriage method) of supplying ink from an ink tank mounted on a carriage together with a printhead may be used.

Figure 4:
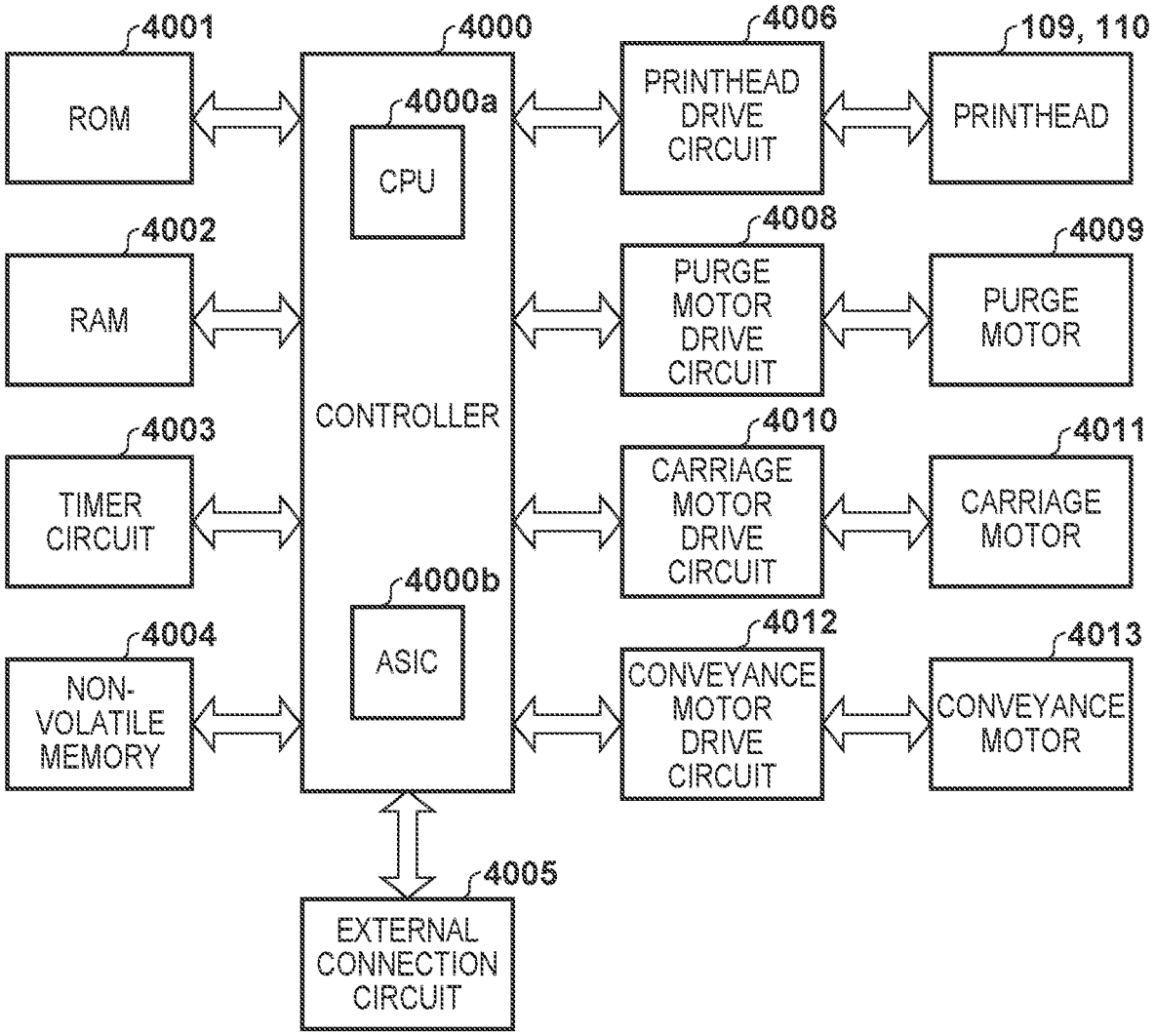
FIG. 4 is a block diagram showing the control arrangement of the printing apparatus shown in FIG. 1.

FIG. 4 is a block diagram showing the control arrangement of the printing apparatus shown in FIG. 1.

In FIG. 4, a ROM 4001 stores a control program to be executed, and setting values in control of the control program, and a RAM 4002 stores a program loaded when executing the control program, image data, and a control instruction, and stores control variables in each control operation. A timer circuit 4003 is a circuit that can acquire the current time or a circuit that can measure an elapsed time. A non-volatile memory (NVRAM) 4004 is a memory that can store parameters stored in a control operation even in a state in which the power of the main body of the printing apparatus 100 is OFF, and start time when calculating an elapsed time in print control or a recovery operation is written and read out in and from the memory.

A control circuit 4000 incorporates a CPU 4000*a* and an ASIC 4000*b*, and the CPU 4000*a* executes the control program stored in the ROM 4001 or the control program loaded into the RAM 4002. Each of sequences to be described in the following embodiments is part of a sequence executed by the control program.

An external connection circuit 4005 is an interface used when the main body of the printing apparatus 100 and an external host apparatus perform wired or wireless communication, and a control signal received via this interface is transferred to the control circuit 4000. In addition, image data for printing is externally received via the external connection circuit 4005. The current time may be input to the main body of the printing apparatus 100 via the external connection circuit 4005.

The control circuit 4000 loads the received image data into the RAM 4002. Furthermore, based on the image data loaded into the RAM 4002, the control circuit 4000 controls driving of each of the printheads 109 and 110 via a printhead drive circuit 4006, and simultaneously controls a carriage motor 4011 via a carriage motor drive circuit 4010. One print scanning operation is executed by discharging ink to any desired position on the print medium under the control of the control circuit 4000. The control circuit 4000 controls a conveyance motor 4013 via a conveyance motor drive circuit 4012 to convey the print medium by a desired amount.

The control circuit 4000 controls a purge motor 4009 via a purge motor drive circuit 4008 to suck any desired ink amount from each of the printheads 109 and 110. With respect to ink discharge to the cap, the control circuit 4000 controls driving of each of the printheads 109 and 110 via the printhead drive circuit 4006 to discharge any desired ink amount. In this case, image data used to drive the printhead is based on one of data loaded into the RAM 4002, data in the ROM 4001, or data generated by the control circuit, similar to the above-described print operation.

Discharge recovery control used in each embodiment to be described below will be explained next.

The printing apparatus 100 executes a recovery operation of the printhead by performing ink discharge not contributing to printing of an image from the orifices into the cap for the purpose of discharging ink with an increased viscosity in the nozzles of the printhead, bubbles, and mixed color ink, and removing ink and dust adhering to portions around the orifices. This operation will be referred to as discharge recovery (preliminary discharge) hereinafter. Note that as discharge recovery, an arrangement of performing, in a place different from the cap, ink discharge not contributing to printing of an image, can be employed. The discharge recovery operation is required when, for example, the cap is opened, head cleaning by the wiper is performed, or printing starts.

<Operation Upon Power-On of Printing Apparatus (FIG. 5)>

Figure 5:
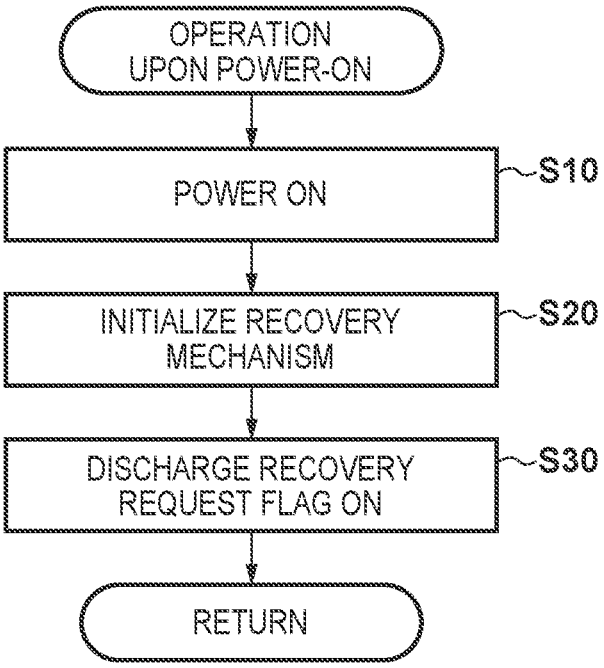
FIG. 5 is a flowchart illustrating an operation at the time of power-on of the printing apparatus shown in FIG. 1.

FIG. 5 is a flowchart illustrating an operation upon power-on of the printing apparatus.

If the printing apparatus 100 is powered on in step S10, the initialization operation of the recovery mechanism 104 is executed in step S20. The initialization operation indicates movement to the home position of the carriage 108 on which the printheads 109 and 110 are mounted and reset of various counters. In the end of the initialization operation, the caps 20*a* and 20*b* are opened to shift to a standby state. This is done to immediately start a print operation even immediately after power-on.

In step S20, the discharge recovery operation is not executed when the caps are opened. A discharge recovery request flag (DRF) is set in step S30, and is stored in the non-volatile memory 4004. The discharge recovery request flag (DRF) is used to control the discharge recovery operation that is required when the caps are opened in step S20, and discharge recovery is executed at a predetermined timing based on the flag.

Note that since the discharge recovery request flag (DRF) is stored in the non-volatile memory 4004, the CPU 4000*a* of the control circuit may read out the previous value from the non-volatile memory 4004 upon power-on, and set it at a predetermined address in the RAM 4002. In the initialization operation, the user may reset the value from the operation panel (not shown) of the printing apparatus 100 or a host apparatus (not shown) that connects the printing apparatus 100.

First Embodiment

Figures 6A, 6B:
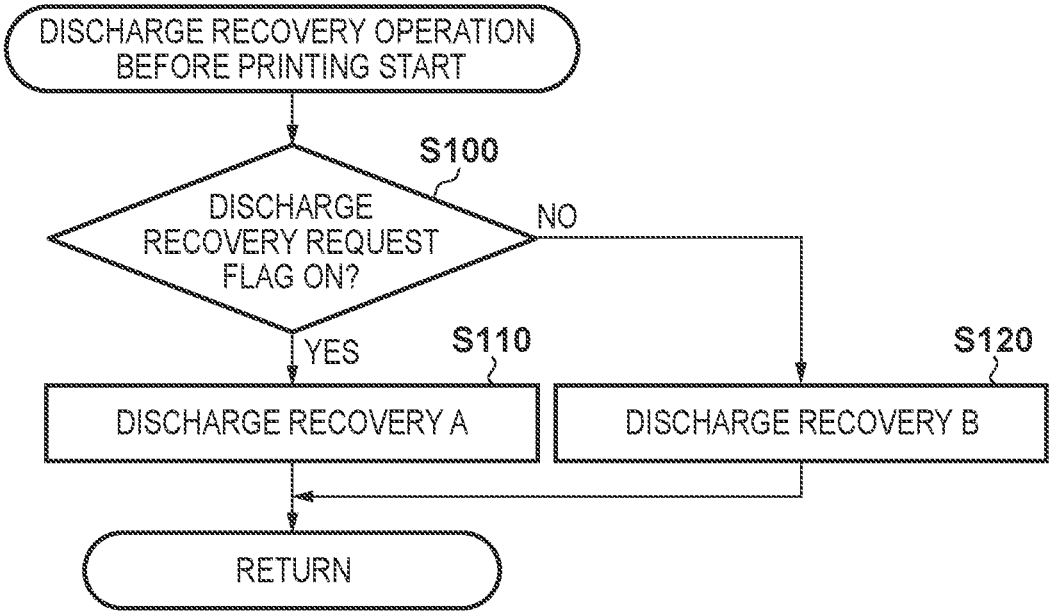
FIGS. 6A and 6B are a flowchart and a table for explaining a discharge recovery operation before the start of printing.

FIGS. 6A and 6B are a flowchart and a table for explaining a discharge recovery operation before the start of printing. FIG. 6A is a flowchart illustrating the processing of the discharge recovery operation before the start of printing. FIG. 6B is a table showing details of the discharge recovery operation shown in FIG. 6A.

As shown in FIG. 6A, before the start of a print operation, it is checked in step S100 whether a discharge recovery request flag (DRF) has been set, that is, whether the flag is ON (the value of the flag is "1"). If it is determined that the discharge recovery request flag (DRF) has been set to ON, the process advances to step S110 and discharge recovery A is executed. On the other hand, if it is determined that the discharge recovery request flag (DRF) has not been set to ON (that is, the value of the flag is "0"), the process advances to step S120 and discharge recovery B in which an ink discharge amount is smaller than in discharge recovery A is executed.

As shown in FIG. 6B, in discharge recovery A, discharge recovery is executed by changing the number discharges in accordance with an elapsed time since the last discharge recovery operation. In an example shown in FIG. 6B, if the elapsed time (T1) satisfies $0 \leq T1 < 6$ hours, the number of discharges is set to 70. If the elapsed time (T1) satisfies $6 \leq T1 < 24$ hours, the number of discharges is set to 800. If the elapsed time (T1) satisfies $T1 \geq 24$ hours, the number of discharges is set to 1,300.

On the other hand, as shown in FIG. 6B, in discharge recovery B, discharge recovery is executed by setting the number of discharges to 30 regardless of the elapsed time since the last discharge recovery operation. As is apparent from FIG. 6B, in discharge recovery B, the ink discharge amount is smaller than in any case in discharge recovery A. This is because it is assumed that the discharge recovery request flag (DRF) is a reservation flag set when a necessary discharge recovery operation is not performed, and if the flag is not set, the necessary recovery operation has already been executed.

As described above, the printing apparatus 100 can perform the different kinds of discharge recovery operations in accordance with the presence/absence (ON or OFF) of setting of the discharge recovery request flag (DRF) before the start of printing after power-on.

Note that the last discharge recovery operation may be discharge recovery A or B. Alternatively, the last discharge recovery operation may be another discharge recovery operation in which the number of discharges, the ink discharge amount, or the like is different. In this example, the elapsed time since the last discharge recovery operation is used as the elapsed time. However, for example, an elapsed time since the last capping operation or an elapsed time since the end time of the last operation may be used.

Furthermore, the elapsed time and the value of the number of times of discharge of discharge recovery A described here are merely examples. Therefore, a threshold of the elapsed time may be different, the number of times of discharge may be different, a combination of the elapsed time and the number of times of discharge may be different, or the elapsed time or the number of times of discharge may be different for each discharge nozzle array. Similarly, the value of the number of times of discharge of discharge recovery B described here is merely an example, and other number of times of discharge may be possible as long as the ink discharge amount is smaller than in discharge recovery A, as a matter of course.

Figure 7:
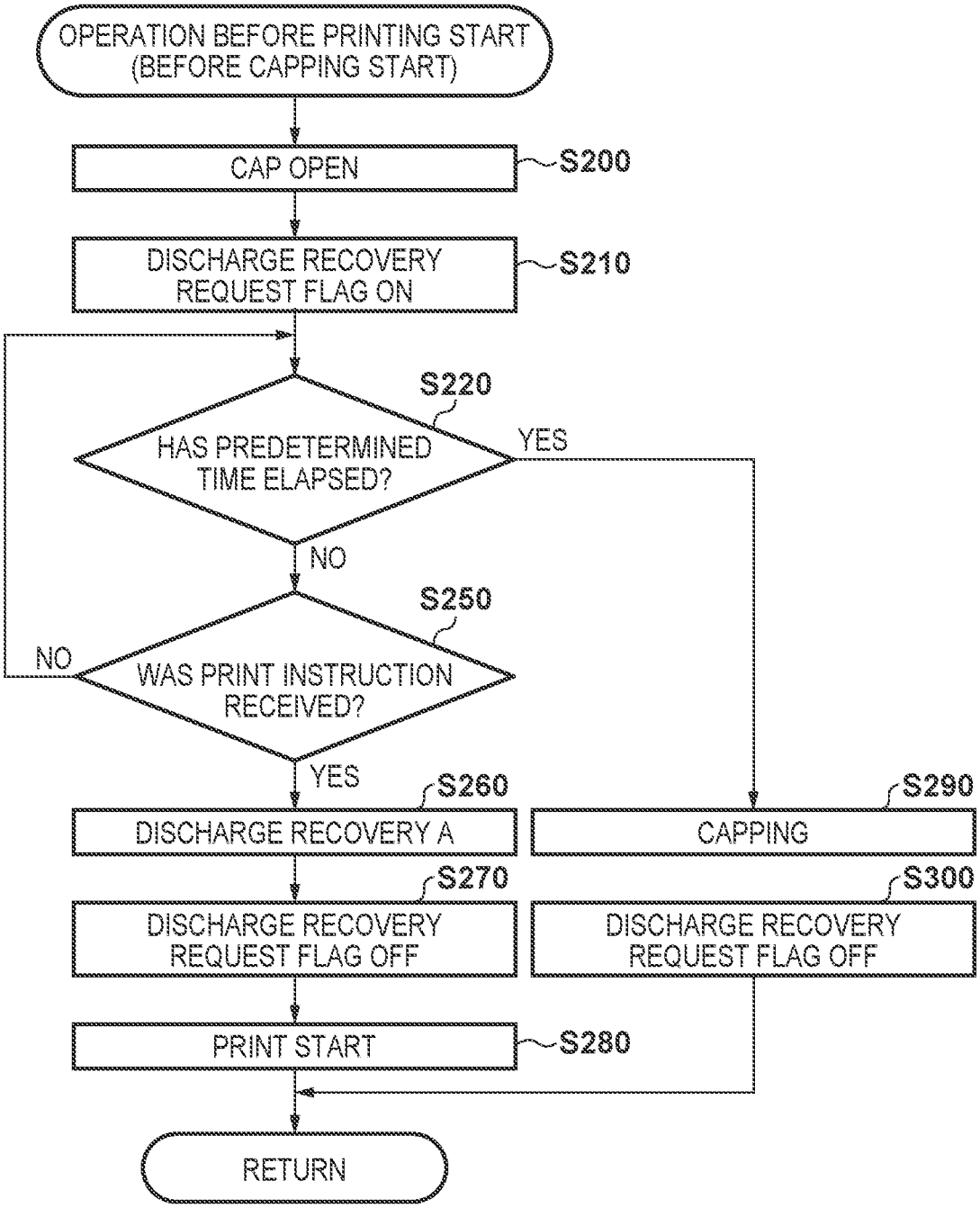
FIG. 7 is a flowchart illustrating an operation before the start of printing according to the first embodiment.

FIG. 7 is a flowchart illustrating an operation before the start of printing when a print instruction is received before the start of a capping operation after the initialization processing of a recovery mechanism.

In step S200, a cap opening operation is executed along with the initialization processing of a recovery mechanism 104. Normally, if the cap is opened, the discharge recovery operation is executed to prevent drying of orifices. However, in this example, the discharge recovery operation is not executed, and the discharge recovery request flag (DRF) is set to ON in step S210. This flag plays a role as a reservation flag for executing, later at a predetermined timing, the discharge recovery operation corresponding an operation in which the necessary discharge recovery operation has not been executed in step S200.

Next, it is checked in step S220 whether a predetermined time has elapsed. The predetermined time indicates a time of at least 0 sec. If it is determined that an elapsed time (T2) has not reached the predetermined time, the process advances to step S250, and it is checked whether a print instruction has been received. The predetermined time is a time from when the cap opening operation is performed until a capping operation is performed, and is set to, for example, 30 sec in this embodiment. If it is determined in step S250 that the print instruction has not been received, the process returns to step S220, and the processing of determining in step S250 whether the print instruction has been received is repeated until the predetermined time elapses.

On the other hand, if it is determined in step S250 that the print instruction has been received, the process advances to step S260, and discharge recovery A is executed in accordance with the discharge recovery request flag (DRF) set to ON in step S210. After that, the process advances to step S270, and the discharge recovery request flag (DRF) is set to OFF. Then, in step S280, the print operation starts.

If it is determined in step S220 that the elapsed time T2 has reached the predetermined time, the process advances to step S290, and the capping operation is executed. After that, the process sets the discharge recovery request flag (DRF) to OFF in step S300. Then, the process ends.

As described above, the discharge recovery request flag (DRF) is used as a reservation flag for performing necessary recovery along with the cap opening operation. Therefore, after execution of the capping operation, the discharge recovery operation need not be performed by reservation of the discharge recovery request flag (DRF), and thus the flag is set to OFF. On the other hand, if the discharge recovery request flag is not set to OFF in step S300, this means that the discharge recovery request is not canceled. In this case, at the time of next cap opening, discharge recovery A according to the flag and the normal discharge recovery operation along with the cap opening operation are executed, and thus the unnecessary discharge recovery operation is unwantedly performed.

For this reason, the discharge recovery request flag (DRF) is set to OFF in step S300.

Therefore, according to the above-described embodiment, if printing is not executed within the predetermined time since opening of the cap of the printhead, the capping operation is performed and the discharge recovery request is canceled. On the other hand, if the print instruction is received within the predetermined time, the print operation starts after performing discharge recovery with a discharge amount according to the elapsed time T1. This makes it possible to perform discharge recovery only when discharge recovery is required for satisfactory printing, thereby suppressing ink consumption by discharge recovery.

Second Embodiment

The first embodiment has explained the example of executing the operation before the start of printing when a print instruction is received before the start of the capping operation. The second embodiment will describe processing when a print instruction is received during execution of a capping operation.

Figure 8:
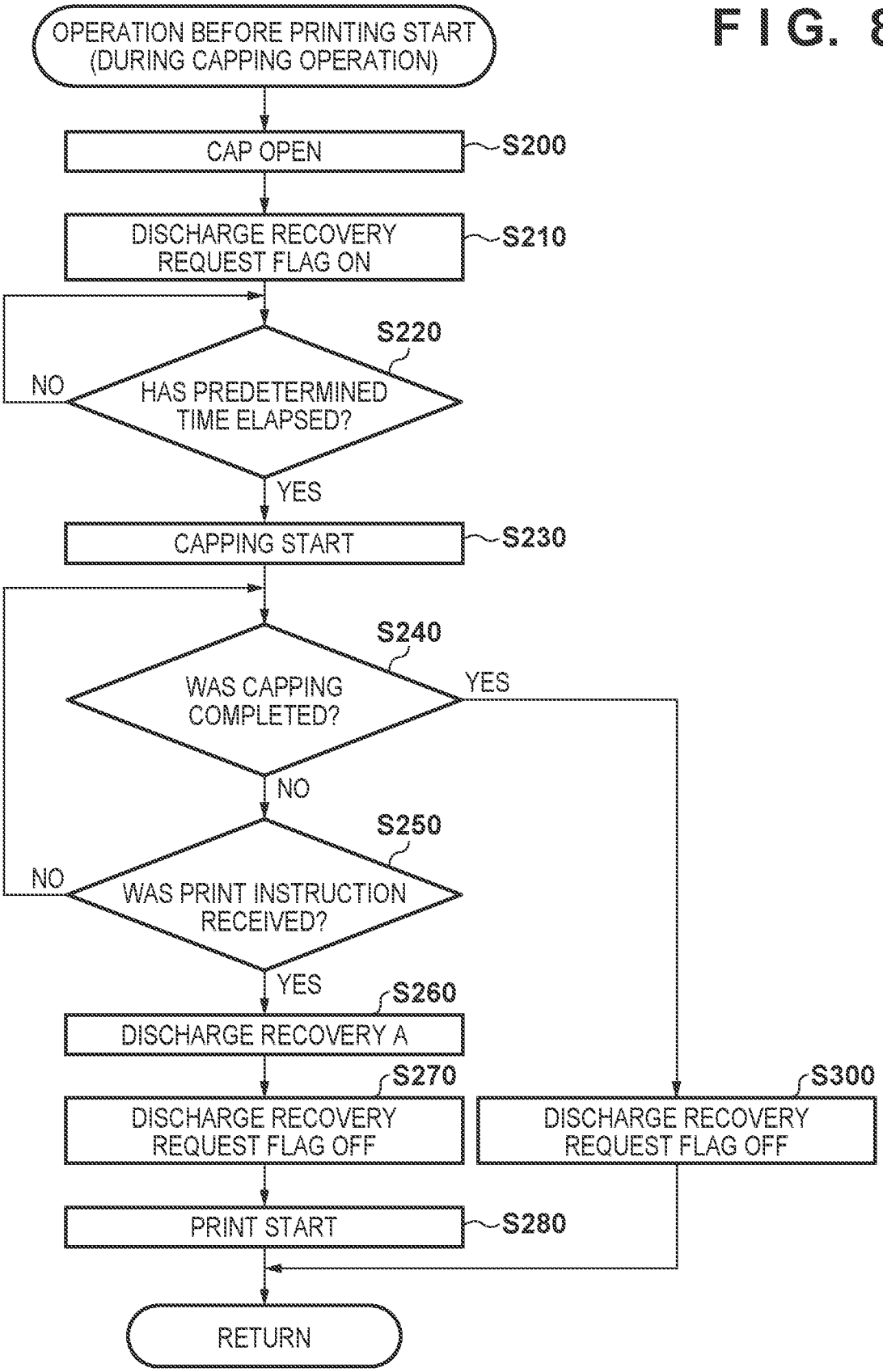
FIG. 8 is a flowchart illustrating an operation before the start of printing according to the second embodiment.

FIG. 8 is a flowchart illustrating an operation before the start of printing according to the second embodiment. In FIG. 8, the same step numbers as those in FIG. 7 already described above denote the same processes and a description thereof will be omitted.

Referring to FIG. 8, after steps S200 and S210, in step S220, the process stands by for a lapse of a predetermined time. If it is determined that the predetermined time (for example, 30 sec) has elapsed, a capping operation starts in step S230. Then, it is determined in step S240 whether the capping operation is complete. If it is determined that the capping operation is incomplete, the process advances to step S250 and it is determined whether a print instruction has been received. If it is determined that no print instruction has been received, the process returns to step S240. As long as the capping operation is incomplete, it is repeatedly determined in step S250 whether the print instruction has been received.

If it is determined in step S250 that the print instruction has been received, the process advances to step S260 and discharge recovery A is executed in accordance with a discharge recovery request flag (DRF). After that, processes in steps S270 and S280 are executed.

On the other hand, if it is determined in step S240 that the capping operation is complete, the process advances to step S300 and the discharge recovery request flag is set to OFF, thereby terminating the process.

Therefore, according to the above-described embodiment, if no print instruction is received even after the predetermined time elapses since opening of the cap of the printhead, the printhead is capped to cancel a discharge recovery request. On the other hand, if the print instruction is received during the capping operation, a print operation starts after performing discharge recovery with a discharge amount according to an elapsed time T1. This makes it possible to perform discharge recovery only when discharge recovery is required for satisfactory printing, and it is thus possible to suppress the ink consumption by discharge recovery.

Third Embodiment

Each of the first and second embodiments has explained the processing of the operation before the start of printing when the print instruction is received before the start of the capping operation or during the capping operation. The third embodiment will describe processing when a print instruction is received after the end of a capping operation.

Figure 9:
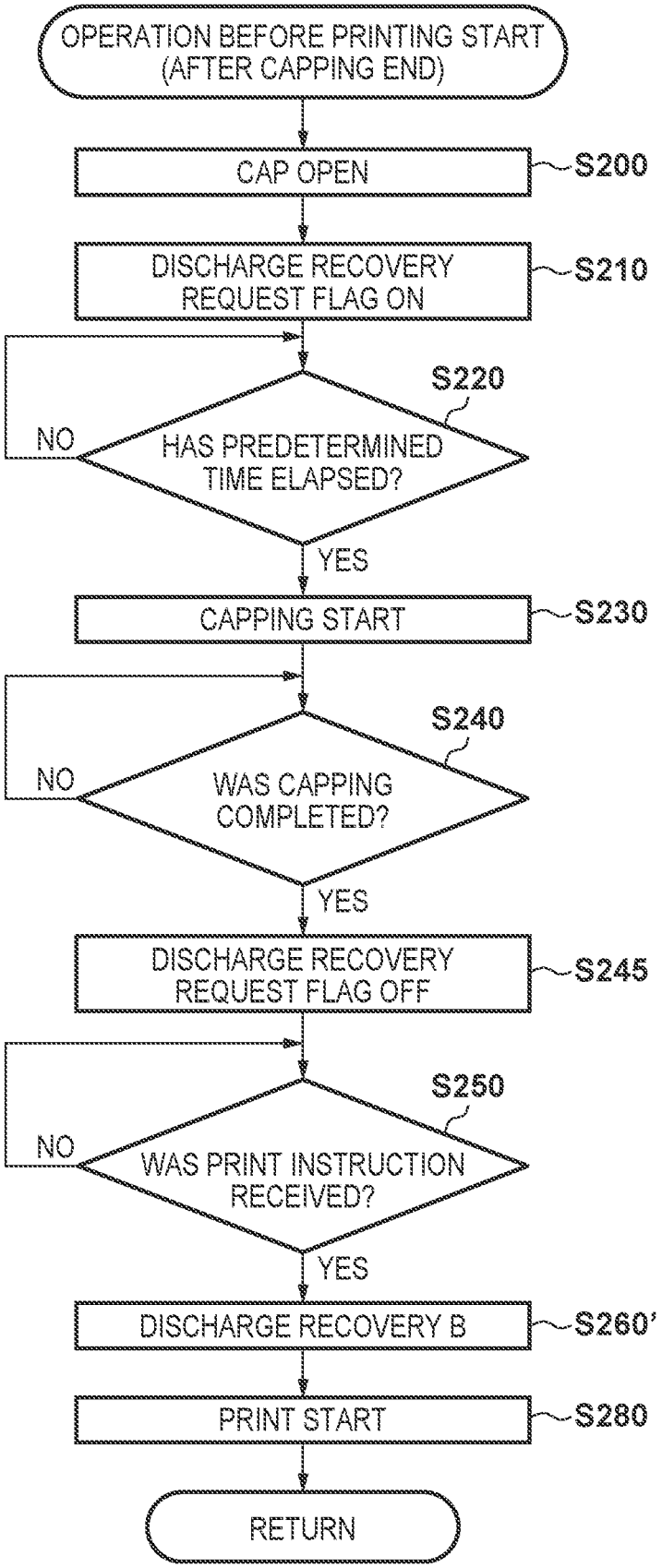
FIG. 9 is a flowchart illustrating an operation before the start of printing according to the third embodiment.

FIG. 9 is a flowchart illustrating an operation before the start of printing according to the third embodiment. Note that in FIG. 9, the same step numbers as those already described in FIGS. 7 and 8 denote the same processes and a description thereof will be omitted.

Referring to FIG. 9, after steps S200 to S230, the process stands by, in step S240, for completion of the capping operation. If it is determined that the capping operation is complete, the process advances to step S245 and a discharge recovery request flag (DRF) is set to OFF. Then, it is determined in step S250 whether a print instruction has been received. The process stands by for reception of the print instruction. If it is determined that the print instruction has been received, the process advances to step S260' and discharge recovery B is executed. After that, in step S280, a print operation starts.

Therefore, according to the above-described embodiment, if no print instruction is received even after a predetermined time elapses since opening of the cap of a printhead, the printhead is capped. After that, if the print instruction is received, the print operation starts after performing discharge recovery with a small ink discharge amount. This makes it possible to suppress the ink consumption by discharge recovery.

Fourth Embodiment

Each of the first to third embodiments has explained the example of the operation by assuming that a flag other than the discharge recovery request flag (DRF) is not set at the time of receiving the print instruction. The fourth embodiment will describe an operation when a suction recovery request flag is set at the time of receiving a print instruction.

A printing apparatus executes recovery of a printhead by a suction recovery operation using a suction mechanism 22 for the purposes of, for example, removing bubbles in the printhead, discharging clogged ink, and filling with ink. A recovery operation is executed when, for example, an ink tank is replaced, a predetermined time elapses after the last execution of the recovery operation, or an amount (dot count) of ink droplets consumed by a print operation after the last execution of the recovery operation becomes equal to or more than a predetermined value. In this status, the suction recovery request flag (SRF) is set to ON, and stored in a non-volatile memory 4004. The printing apparatus executes the recovery operation at a predetermined timing based on the suction recovery request flag.

Similar to the discharge recovery request flag (DRF), a printing apparatus 100 (a CPU 4000*a* of a control circuit) sets the suction recovery request flag (SRF) when the printing apparatus 100 is powered on and the initialization operation of a recovery mechanism 104 is executed. As described above, similar to the discharge recovery request flag (DRF), a previous value may be read out from the non-volatile memory (NVRAM) 4004 at the time of power-on, and set at a predetermined address in a RAM 4002. In the initialization operation, the user may reset the suction recovery request flag from the operation panel (not shown) of the printing apparatus 100 or a host apparatus (not shown) that connects the printing apparatus 100.

Figure 10:
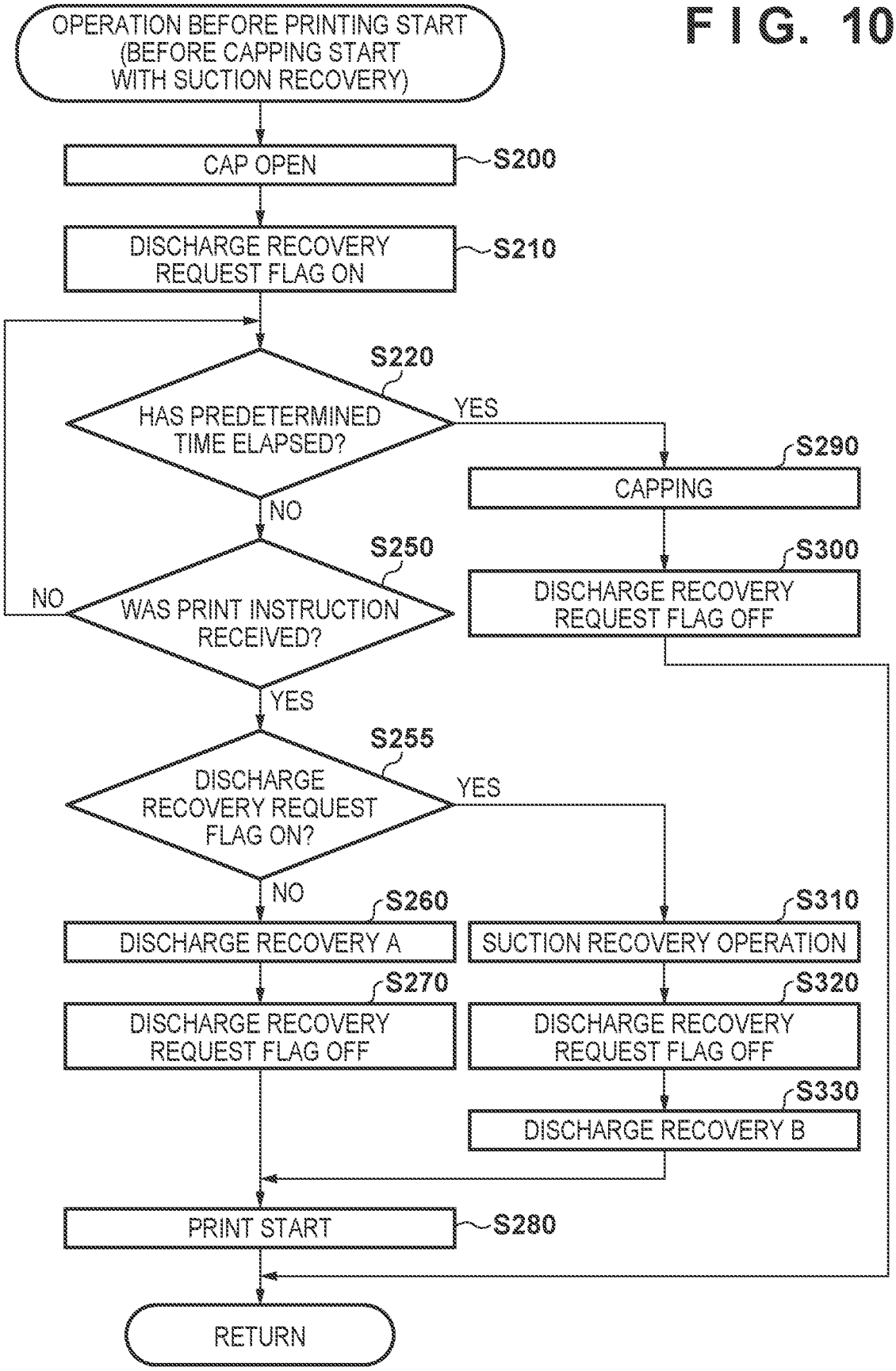
FIG. 10 is a flowchart illustrating an operation before the start of printing according to the fourth embodiment.
Figure 11:
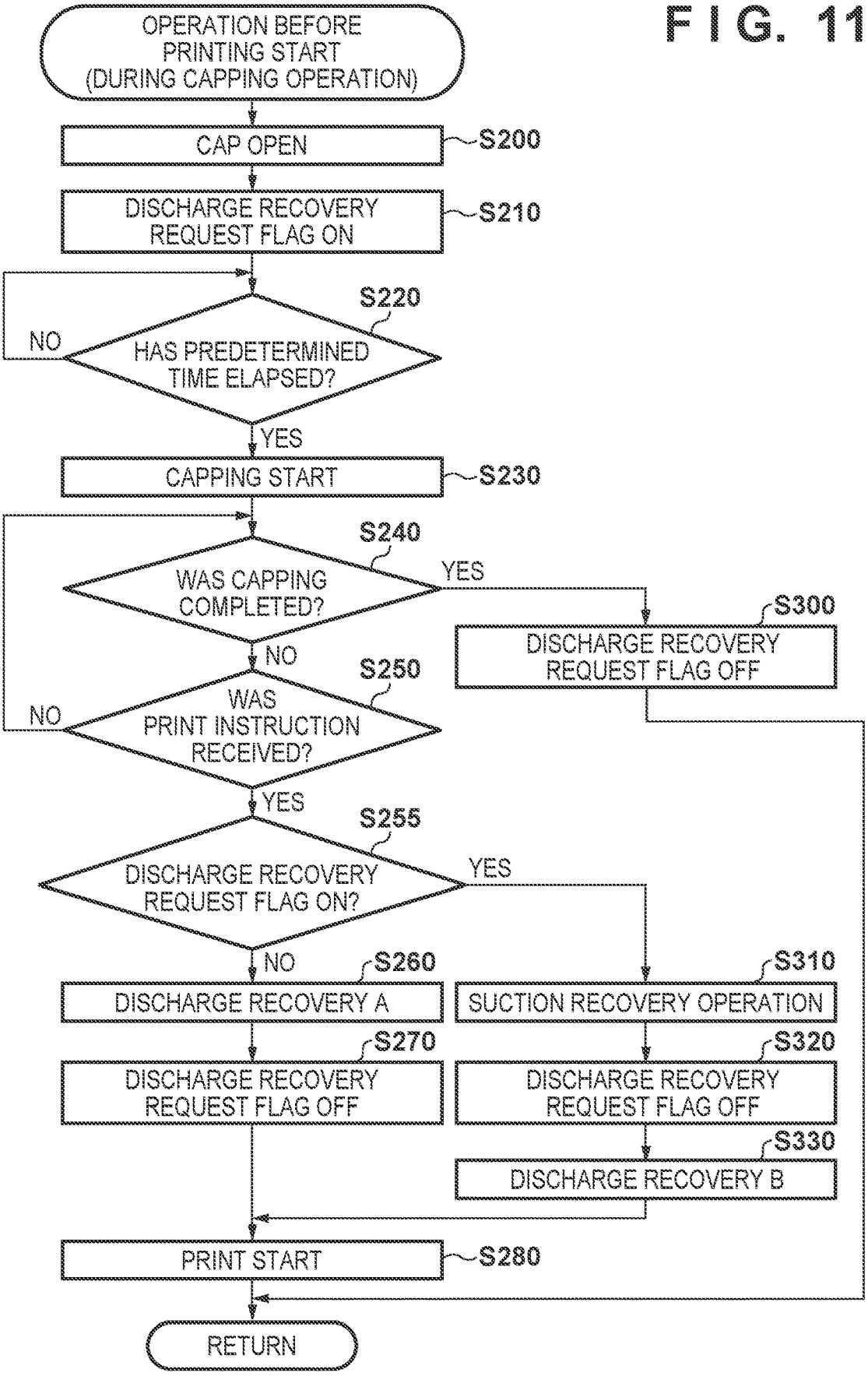
FIG. 11 is a flowchart illustrating the operation before the start of printing according to the fourth embodiment.
Figure 12:
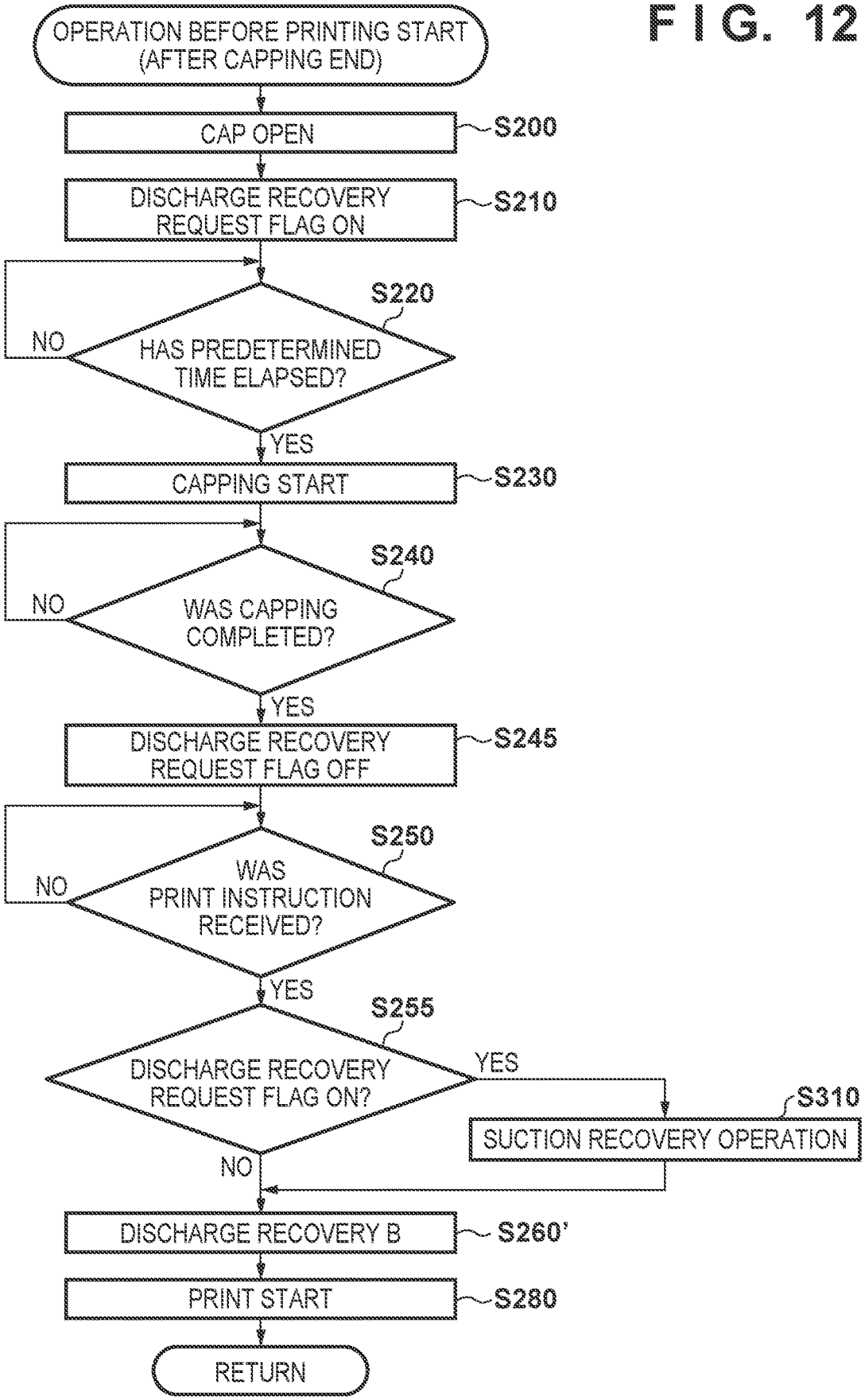
FIG. 12 is a flowchart illustrating the operation before the start of printing according to the fourth embodiment.

FIGS. 10 to 12 are flowcharts each illustrating an operation before the start of printing according to the fourth embodiment. Note that in FIGS. 10 to 12, the same step numbers as those already described in FIGS. 7 to 9 denote the same processes and a description thereof will be omitted. This embodiment performs processing in which determination of whether the suction recovery request flag (SRF) has been set is added after a print instruction is received. This determination processing is executed at several timings. This embodiment assumes the following three timings. That is, (1) before a capping operation (FIG. 10)

(2) during the capping operation (FIG. 11)

(3) after the end of the capping operation (FIG. 12)

Referring to FIG. 10, similar to the first embodiment, after executing processes in steps S200 to S220 and S250, that is, after receiving the print instruction, it is checked in step S255 whether the suction recovery request flag (SRF) has been set to ON. If it is determined that the suction recovery request flag (SRF) has not been set to ON (that is, OFF), the process executes steps S260 to S280, similar to the second embodiment. On the other hand, if it is determined that the suction recovery request flag (SRF) has been set to ON, the process advances to step S310, and the suction recovery operation is executed. After that, in step S320, the suction recovery request flag (SRF) is set to OFF to cancel a discharge recovery request. This is done to prevent wasteful ink consumption because it is considered that the orifices of the printhead can be recovered to a satisfactory state after the suction recovery operation. In step S330, discharge recovery B is executed. The process then advances to step S280, thereby starting the print operation.

Note that if it is determined in step S220 that a predetermined time (for example, 30 sec) has elapsed, processes in steps S290 and S300 are executed, similar to the first embodiment.

FIG. 11 is a flowchart illustrating the operation before the start of printing when a print instruction is received during the capping operation.

Referring to FIG. 11, similar to the second embodiment, after executing processes in steps S200 to S250, that is, after receiving the print instruction, it is checked in step S255 whether the suction recovery request flag (SRF) has been set to ON. If it is determined that the suction recovery request flag (SRF) has not been set to ON (that is, OFF), the process executes steps S260 to S280, similar to the second embodiment. On the other hand, if it is determined that the suction recovery request flag (SRF) has been set to ON, the process advances to step S310, and the suction recovery operation is executed. After that, in step S320, the discharge recovery request flag (DRF) is set to OFF to cancel a discharge recovery request. Furthermore, in step S330, discharge recovery B is executed. The process then advances to step S280, thereby starting the print operation.

Note that if it is determined in step S240 that the capping operation is complete, processing in step S300 is executed, similar to the second embodiment.

FIG. 12 is a flowchart illustrating the operation before the start of printing when a print instruction is received after the end of the capping operation.

Referring to FIG. 12, similar to the third embodiment, after executing processes in steps S200 to S245 and S250, that is, after receiving the print instruction, it is checked in step S255 whether the suction recovery request flag (SRF) has been set to ON. If it is determined that the suction recovery request flag (SRF) has not been set to ON (that is, OFF), the process executes steps S260' and S280, similar to the third embodiment. On the other hand, if it is determined that the suction recovery request flag (SRF) has been set to ON, the process advances to step S310, and the suction recovery operation is executed. After that, the process advances to step S260', and then advances to step S280, thereby starting the print operation.

Therefore, according to the above-described embodiment, if, in addition to discharge recovery of the recovery operation, recovery of the printhead is performed by suction recovery when a suction recovery request is received, it is possible to suppress discharge recovery after suction recovery, thereby preventing wasteful ink consumption by the overlapping operation of suction recovery and discharge recovery.

Note that each of the above-described first to fourth embodiments has explained the example of selecting the recovery amount of discharge recovery A in accordance with the elapsed time since last discharge recovery. However, the present invention is not limited to this. For example, discharge recovery may be executed only for a discharge nozzle to be used for print data.

In addition, the present invention is applicable to a single-function inkjet printing apparatus as well as a facsimile, a copying machine, a word processor, and a multifunction peripheral device each of which uses an inkjet printing apparatus as a print unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-070713, filed Apr. 2, 2019, which is hereby incorporated by reference herein in its entirety.

What is claimed is:

1. A printing apparatus comprising:

a printhead including a discharge surface with at least one orifice discharging liquid by driving a print element, wherein the print element is controllably operable to perform preliminary discharge that does not contribute to print of an image;

a cap configured to cap the discharge surface;

an executing unit configured to execute an initialization operation including opening the cap upon power-on of the printing apparatus; and a control unit configured to control driving of the print element, wherein the control unit controls, in a case where a print instruction is not received within a predetermined time after opening the cap in the initialization operation, the print element so as not to perform the preliminary discharge.

2. The apparatus according to claim 1, wherein, in a case where the print instruction is received within the redetermined time after opening the cap in the initialization operation, the control unit controls the print element to perform the preliminary discharge before the printhead performs printing.

3. The apparatus according to claim 2, further comprising:

a suction unit configured to suction the liquid from the orifice, wherein, in a case where the print instruction is received within the predetermined time after opening the cap in the initialization operation, the control unit controls the print element to perform the preliminary discharge and the suction unit suctions the liquid before the printhead performs printing.

4. The apparatus according to claim 1, wherein, in a case where a print instruction is not received within a predetermined time after opening the cap in the initialization operation, the cap caps the discharge surface.

5. The apparatus according to claim 1, wherein the liquid is supplied from a tank configured to store the liquid to the printhead through a supply path.

6. The apparatus according to claim 5, wherein the supply path is formed by a tube.

7. A printing apparatus comprising:

a printhead including a discharge surface with at least one orifice discharging liquid by driving a print element, wherein the print element is controllably operable to perform preliminary discharge that does not contribute to print of an image;

a cap configured to cap the discharge surface;

an executing unit configured to execute an initialization operation including opening the cap upon power-on of the printing apparatus; and a control unit configured to control driving of the print element, wherein, in a case where a print instruction is received during execution of closing the cap after opening the cap in the initialization operation, the control unit controls the print element to perform the preliminary discharge before the printhead performs printing.

8. The apparatus according to claim 7, further comprising:

a suction unit configured to suction the liquid from the orifice, wherein in a case where a print instruction is received during execution of closing the cap after opening the cap in the initialization operation, the control unit controls the print element to perform the preliminary discharge and the suction unit suctions the liquid before the printhead performs printing.

9. The apparatus according to claim 7, wherein the liquid is supplied from a tank configured to store the liquid to the printhead through a supply path.

10. The apparatus according to claim 9, wherein the supply path is formed by a tube.

11. A control method for a printing apparatus comprising a printhead and a cap, wherein the printhead includes a discharge surface with at least one orifice discharging liquid by driving a print element, wherein the print element is controllably operable to perform preliminary discharge that does not contribute to print of an image, and wherein the cap is configured to cap the discharge surface, the method comprising:

executing an initialization operation including opening the cap upon power-on of the printing apparatus, and controlling, in a case where a print instruction is not received within a predetermined time after opening the cap in the initialization operation, the print element so as not to perform the preliminary discharge.

12. The method according to claim 11, further comprising:

controlling, in a case where the print instruction is received within the predetermined time after opening the cap in the initialization operation, the print element to perform the preliminary discharge before the printhead performs printing.

13. The method according to claim 11, further comprising:

capping the discharge surface with the cap in a case where a print instruction is not received within a predetermined time after opening the cap in the initialization operation.

* * * * *